US005339792A

United States Patent [19]

McCain

[11] Patent Number: 5,339,792

[45] Date of Patent: Aug. 23, 1994

[54] ARCHERY SIGHTING APPARATUS

[76] Inventor: Robert F. McCain, 1705 Linda La., Rossville, Ga. 30741

[21] Appl. No.: 31,704

[22] Filed: Mar. 15, 1993

[51] Int. Cl.[5] ..... F41G 1/467

[52] U.S. Cl. ..... 124/87; 33/265

[58] Field of Search ..... 124/23.1, 24.1, 25.6, 124/86, 87, 88; 33/265

[56] References Cited

U.S. PATENT DOCUMENTS

| | | | |
|---|---|---|---|
| 2,788,701 | 4/1957 | Browning | 33/265 X |
| 3,524,440 | 8/1970 | Hill | 124/87 X |
| 3,861,051 | 1/1975 | Killian | 33/265 |
| 4,178,693 | 12/1979 | Smith | 33/265 |
| 4,555,856 | 12/1985 | Brown | 33/265 |
| 4,646,444 | 3/1987 | Cary | 33/265 |
| 4,979,309 | 12/1990 | Oligschlaeger | 124/87 X |
| 4,995,166 | 2/1991 | Knemeyer | 33/265 |
| 5,090,805 | 2/1992 | Stawarz | 124/87 X |

*Primary Examiner*—Randolph A. Reese
*Assistant Examiner*—John A. Ricci
*Attorney, Agent, or Firm*—E. Michael Combs

[57] ABSTRACT

A sighting apparatus includes a sight housing mounted to a bow riser of an associated archery bow, with a trigger lever mounted therebelow, wherein the trigger lever is operative to effect vertical movement of a cross hair relative to the second mirror plate that is arranged in a fixed orientation cooperative with the first mirror plate, wherein the first mirror plate is arranged to receive incoming light from a target. An opening through the housing is adjacent the second mirror plate. With the target at an incidental distance from the first mirror, the trigger is operative to simultaneously effect vertical displacement of the horizontal cross hair and align the image of the target of the second mirror with the target in the open view. Subsequent alignment of the cross hairs to the target by maneuvering the bow effects sighting relative to the target at the given distance.

3 Claims, 5 Drawing Sheets

ARCHERY SIGHTING APPARATUS

BACKGROUND OF THE INVENTION

1. Field of the Invention

The field of invention relates to archery sighting apparatus, and more particularly pertains to a new and improved archery sighting apparatus wherein the same is directed to the defining and triangulation of an objective target relative to the sighting structure.

2. Description of the Prior Art

The instant invention is directed to the a sighting structure in an archery sighting procedure to provide for the proper sighting and alignment of a target. Prior art sighting structure has heretofore utilized various organizations for target sighting and the like as indicated in the U.S. Pat. Nos. 4,878,752; 4,750,269; 4,679,344; 4,483,598; and 4,928,394.

Replication of a target spacing for alignment of an archery bow and arrow relative to a target, ease of range compensation permanently mounted to an archery bow in this respect, the present invention substantially fulfills this need.

SUMMARY OF THE INVENTION

In view of the foregoing disadvantages inherent in the known types of archery sighting apparatus now present in the prior art, the present invention provides an archery sighting apparatus wherein the same is arranged to effect triangulation of mirror structure relative to a predetermined target for sighting in an archery shooting procedure. As such, the general purpose of the present invention, which will be described subsequently in greater detail, is to provide a new and improved archery sighting apparatus which has all the advantages of the prior art archery sighting apparatus and none of the disadvantages.

To attain this, the present invention provides a sighting apparatus including a sight housing mounted to a bow riser of an associated archery bow, with a trigger lever mounted therebelow, wherein the trigger lever is operative to effect vertical movement of a cross hair relative to the second mirror plate with a second mirror plate arranged in a fixed orientation cooperative with the first mirror plate, wherein the first mirror plate is arranged to receive incoming light from a target. An opening through the housing is adjacent the second mirror plate. With the target at an incidental distance from the first mirror, the trigger is operative to simultaneously effect vertical displacement of the horizontal cross hair and align the image of the target of the second mirror with the target in the open view. Subsequent alignment of the cross hairs to the target by maneuvering the bow effects sighting relative to the target at the given distance.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery sighting apparatus which has all the advantages of the prior art archery sighting apparatus and none of the disadvantages.

It is another object of the present invention to provide a new and improved archery sighting apparatus which may be easily and efficiently manufactured and marketed.

It is a further object of the present invention to provide a new and improved archery sighting apparatus which is of a durable and reliable construction.

An even further object of the present invention is to provide a new and improved archery sighting apparatus which is susceptible of a low cost of manufacture with regard to both materials and labor, and which accordingly is then susceptible of low prices of sale to the consuming public, thereby making such archery sighting apparatus economically available to the buying public.

Still yet another object of the present invention is to provide a new and improved archery sighting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
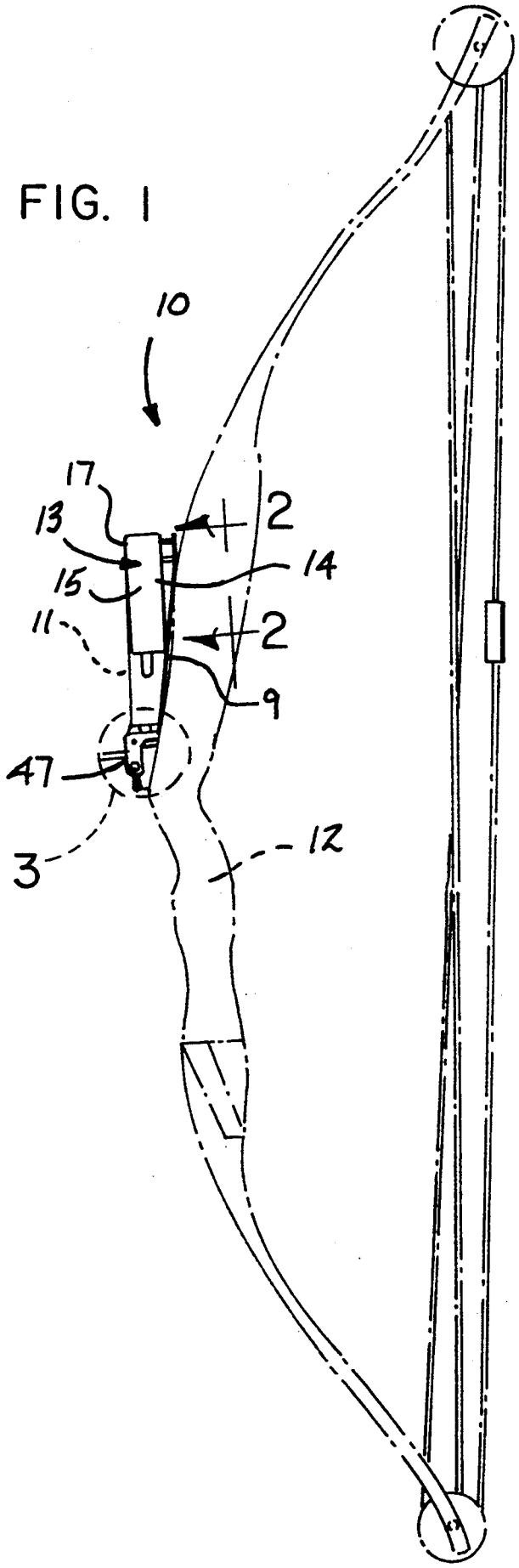
FIG. 1 is an orthographic side view of the instant invention.

With reference now to the drawings, and in particular to FIGS. 1 to 10 thereof, a new and improved archery sighting apparatus embodying the principles and concepts of the present invention and generally designated by the reference numeral 10 will be described.

Figure 2:
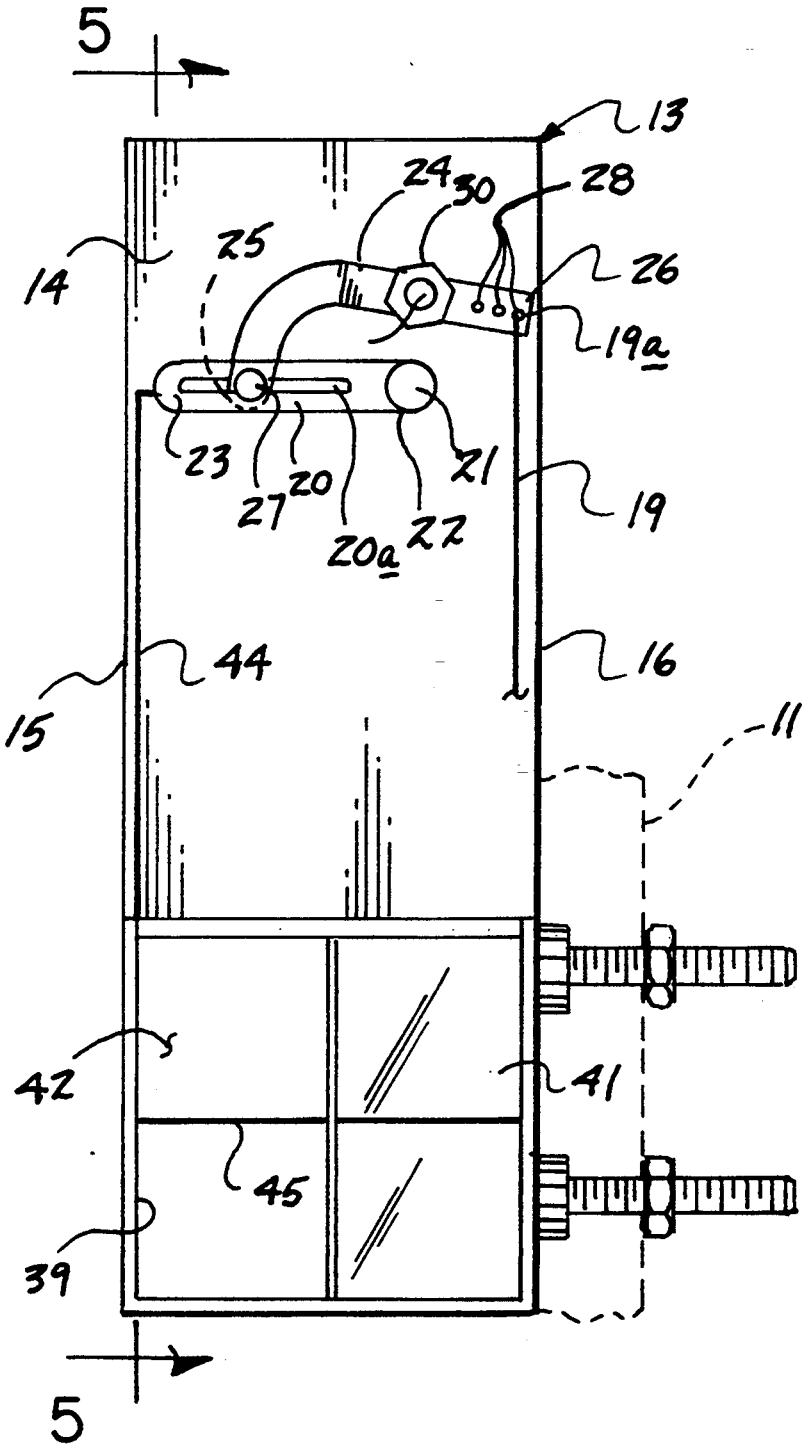
FIG. 2 is an orthographic view, taken along the lines 2—2 of FIG. 1 in the direction indicated by the arrows.
Figure 3:
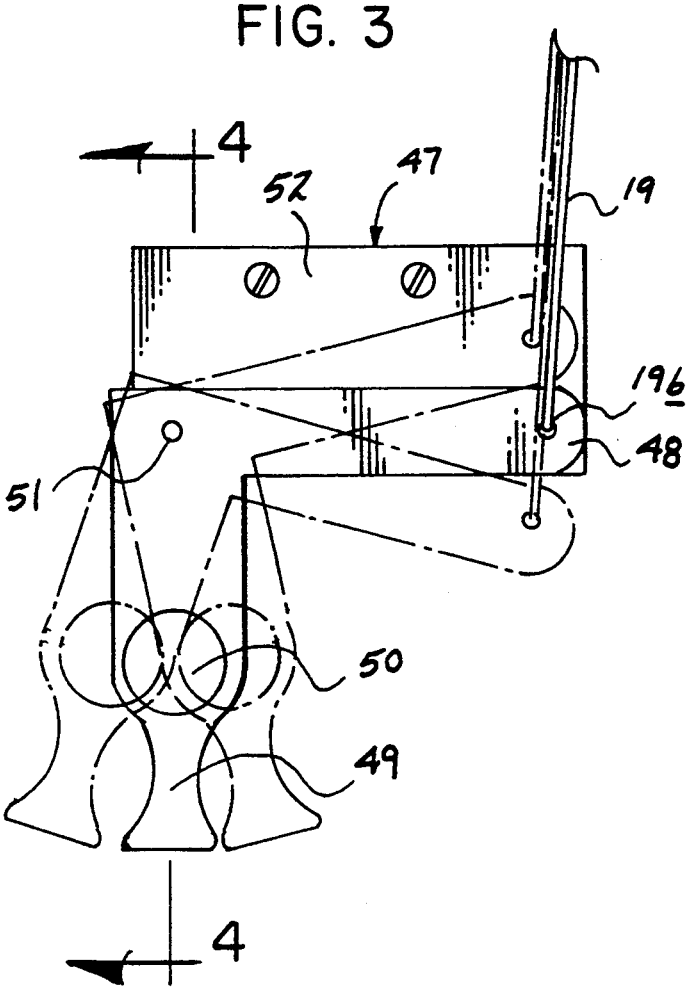
FIG. 3 is an orthographic view of the trigger lever structure of the invention.
Figure 5:
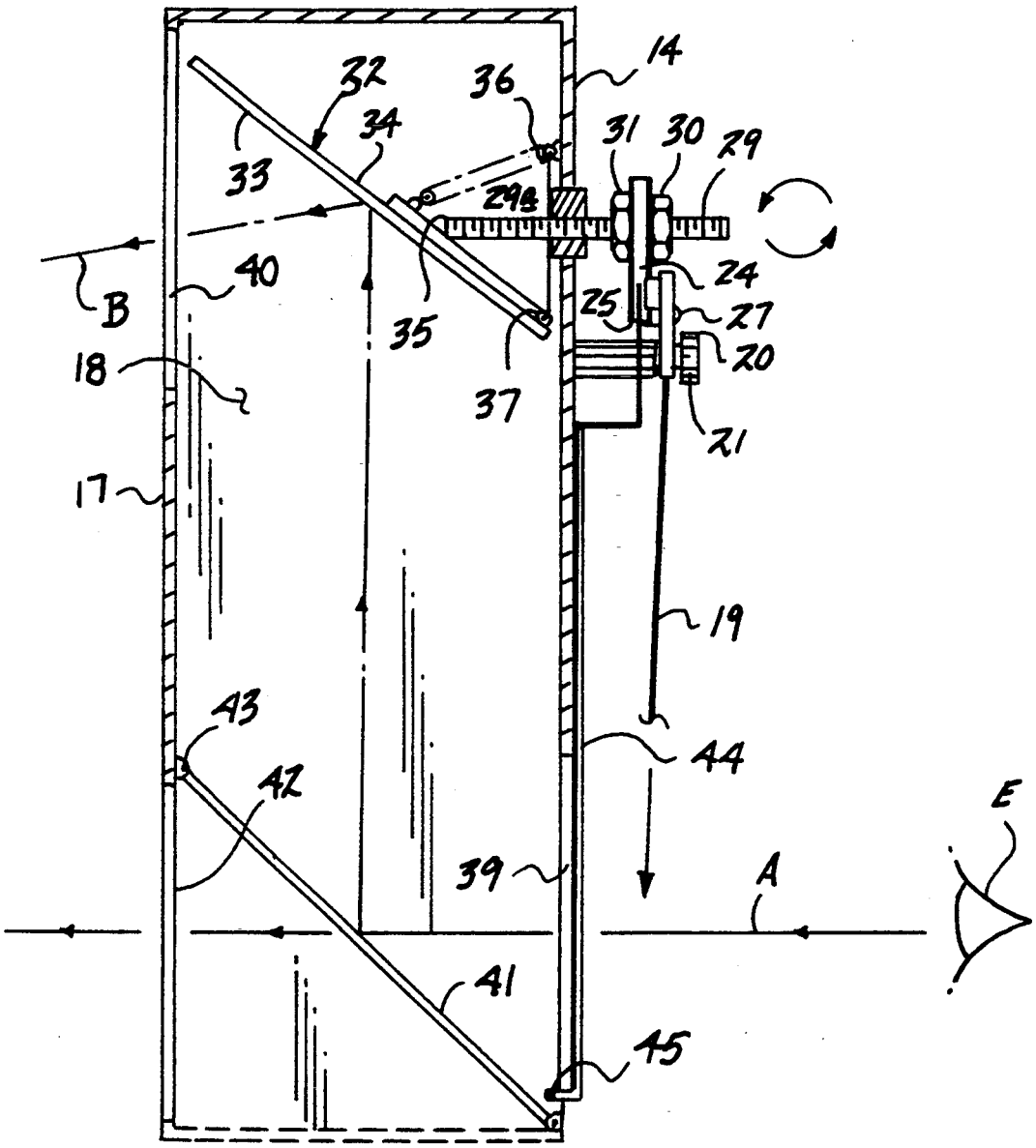
FIG. 5 is an orthographic view, taken along the lines 5—5 of FIG. 2 in the direction indicated by the arrows.
Figure 6:
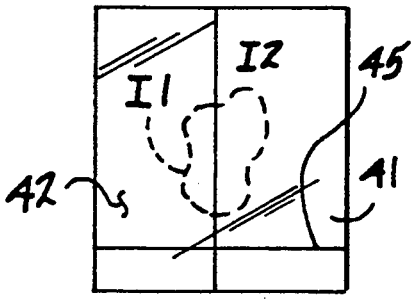
FIG. 6 is an orthographic view of the cross hair structure in a displaced orientation.
Figure 7:
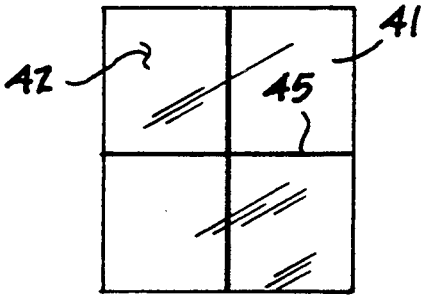
FIG. 7 is an orthographic view of the second mirror in an aligned orientation of the cross hairs relative to one another.
Figure 8:
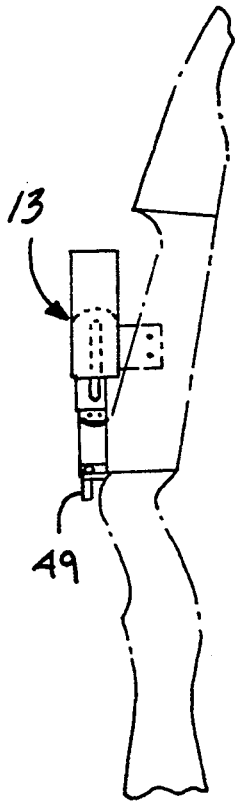
FIG. 8 is an orthographic side view of the trigger structure relative to the housing of the invention.

More specifically, the archery sighting apparatus 10 of the instant invention essentially comprises an archery bow structure, as illustrated in FIG. 1, having a bow riser 11 positioned above a bow hand grip 12. The bow riser 11 includes a sight housing 13 mounted thereon, with a trigger lever 47 positioned pivotally below the sight housing 13 on the riser portion 11 of the archery bow. The sight housing 13 is formed with a housing rear wall 14 spaced from a front wall 17, and a first side wall 15 spaced from a second side wall 16. Within the housing is a generally elongate housing cavity 18 longitudinally aligned relative to the housing, and wherein the housing is arranged to include a top wall and optionally a bottom wall, as indicated in FIG. 5. An actuator rod 19 extends from the trigger lever 47 to the sight housing 13, with the actuator rod 19 having an actuator rod first end **19*a* pivotally mounted to a linkage organization, as illustrated in FIG. 2. The linkage organization includes a first link 20 having a first link pivot axle 21 mounting the first link's first end 22, with the pivot axle 21 orthogonally mounted into the rear wall spacing the first link 21 in a parallel relationship relative to the rear wall 14. The first link second end 23 includes a cross hair 45 actuator linkage 4.4, to be discussed in more detail below. An L-shaped second link 24 is mounted pivotally above the first link 20. The L-shaped second link 24 includes a second link first end 25 having a second link first pivot axle 27 slidably received within slot 20*a* of the first link 20 pivotally mounting the second link to the first link intermediate the first link's first and second ends 22 and 23. The second link includes a second link second end 26 having a row of second link adjusting apertures 28 to receive through one of said apertures through actuator rod's first end 19*a*, with the actuator rod second end 19*b* extending below the sight housing 13 for securement to the trigger lever 47, in a manner as indicated in FIG. 3. The second link further includes a second link second pivot axle 29 orthogonally directed through the second link received through the rear wall 14 (see FIG. 5) in a threaded inter-relationship relative to the rear wall. Respective outer and inner fasteners 31 and 30 are positioned on opposed sides of the second link positioned as the second link relative to a second link second axle, wherein the second link second axle includes a second axle inner end 35 directed into the housing cavity 18 into abutment with a first mirror plate 32. A lock fastener 29*a* relatively and adjustably secures the second pivot axle 29 to the housing rear wall 14 permitting longitudinal adjustment of the second axle inner end 35 for tilting of the first mirror plate 32 with the spring 36 biasing abutment of the first mirror plate 35 to the axle 29. The first mirror plate 32 includes a reflective surface 33 inclined at an acute angle relative to the rear wall 14 and the forward wall 17 positioned in adjacency to a front wall first opening 40 to direct incoming light to the reflective surface 33 of the first mirror plate 32. A front wall second opening 42 is directed to the front wall below the first opening 40 and in alignment and coextensive with the rear wall opening 39 mounted through the rear wall, with the front wall opening and the rear wall opening positioned in adjacency relative to a lower end of the housing adjacent the floor portion thereof. The mirror plate's opaque surface 34 on an opposed side relative to the reflective surface 33 receives a second link second axle inner end 35. As the mirror plate 32 is pivotally mounted about a first mirror plate's pivot hinge 37, threaded projection of the second link's second pivot axle 29 through the rear wall 14 permits angular displacement and adjustment of the first mirror plate relative to the rear wall 14. A spring member 36 mounted between the first mirror plate's opaque surface 34 and the rear wall 14 within the cavity 18 provides for biasing the first mirror plate to the axle 29 in a predetermined adjusted orientation relative to the rear wall and to the front wall opening 40. If required, the lock fastener 29*a* is provided to effect axial adjustment of the second axle 29 relative to the rear wall 14, as illustrated. The second mirror plate is mounted adjacent the lower end of the cavity 18 below the first mirror plate adjacent to but offset relative to the front wall second opening 42, as illustrated. With the first mirror plate's opaque surface arranged in confronting relationship relative to the rear wall 14, the second mirror plate reflective surface is arranged in confronting relationship relative to the rear wall to direct incoming light from the first mirror plate to the second mirror plate and through a rear wall opening 39 for observation by an archery shooter, and more specifically by the archery shooter's eye "E", as indicated in FIG. 5. In this manner, a first line of sight "A" is directed through the first opening "A" and through the rear wall opening 39 and the second front wall opening 42 to view an image I1, as indicated in FIG. 6. A second image I2 is reflected upon the second mirror 41 from a second line of sight "B" that is reflected from the first mirror 32. Proper focusing of the images I1 and I2 is effected utilization of the link axle 29 to permit the proper tilting of the first mirror 32. Simultaneous to proper focusing and alignment, in a manner as indicated in FIG. 6, the cross hair structure 45 is raised and lowered for a range finding and range compensating effect of the invention by permitting accommodation of various ranges once a fixed distance is focused and the cross hair 45 may then be in a lower orientation, as indicated in FIG. 6, for a long distance or in a raised orientation, such as indicated in FIG. 5, for a closer target configuration. Pivoting of the trigger lever 27 effects displacement of the cross hair 45 relative to the second mirror plate 41**.

Figure 4:
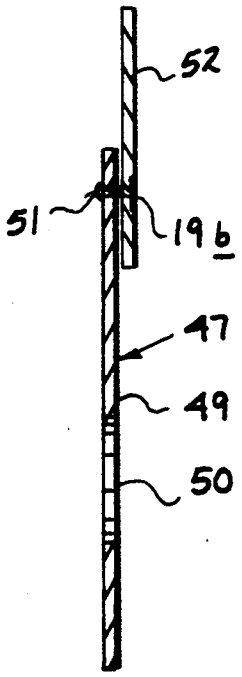
FIG. 4 is an orthographic view, taken along the lines 4—4 of FIG. 3 in the direction indicated by the arrows.

The trigger lever 47, as indicated in the FIGS. 3 and 4, is of an L-shaped configuration having a first leg orthogonally mounted to a second leg 49. The second leg 49 has a finger opening 50 directed therethrough for receiving an individual's finger for a non-slip securement of the trigger lever 47 in adjustment of the sighting structure. The trigger lever 47 is pivotally mounted about a trigger lever pivot axle at an intersection of the first and second legs 48 and 49 together, with the pivot axle 41 pivotally mounted about a mounting plate 52 that in turn is secured to the bow riser 11. In this manner, triangulation of a target relative to the first and second mirror plates and the individual is effected to permit the individual to provide a focus upon the target. The alignment of the image upon the second mirror confined to a shooter that the horizontal cross hair is at the correct elevation for shooting at the target in focus. By a shooter focusing the mirror manually until an unbroken, unsplit image is viewed upon the second mirror plate and through the front wall second opening 42 relative to a shooter, the shooter may then direct an arrow onto the target when properly aligned relative to the second mirror plate.

Figure 9:
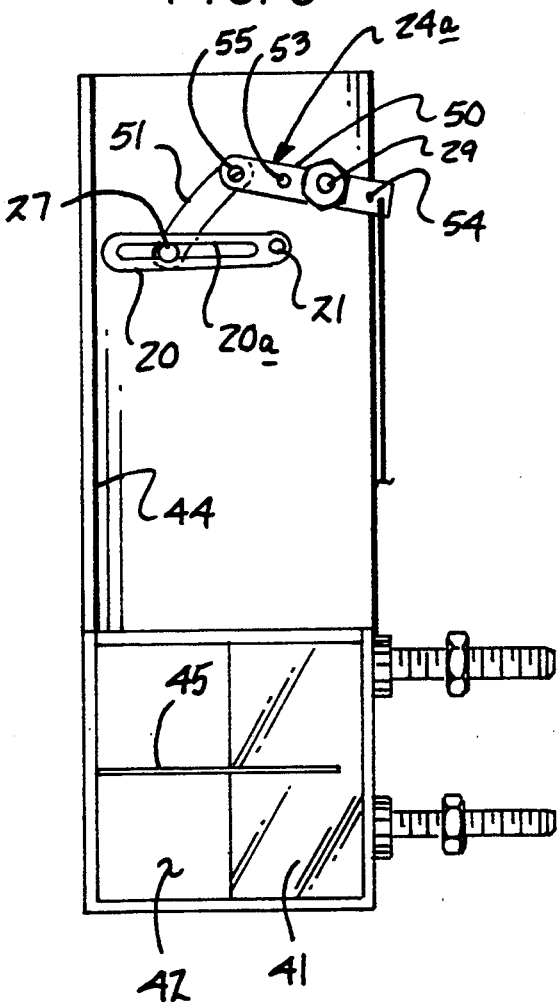
FIG. 9 is an orthographic view of the linkage structure utilizing an elongate slot relative to the first link.
Figure 10:
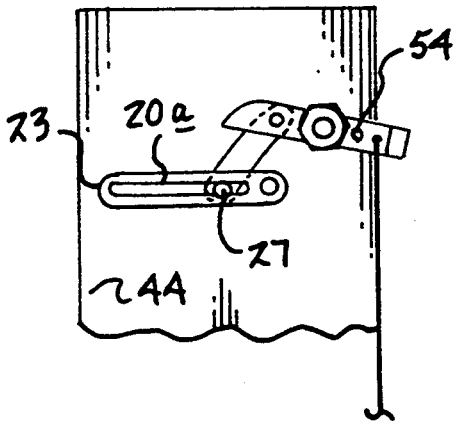
FIG. 10 is an orthographic partial section view of the first link and second link arranged in a displaced orientation relative to one another.

FIG. 9 indicates the use of the modified first link 24*a* having a first link segment 50 to a second link segment 51 by a link segment fastener 55. The first link segment includes first and second bores 53 and 54 respectively (see FIGS. 10 and 9) to permit altering mechanical advantage of pivoting the first link 20 relative to the modified second link 24*a*. The slotted inter-relationship of the axle 27 through the slot 20*a* effects a non-linear reciprocation Of the actuator linkage 44 in displacement of the cross hair 45. The first and second bores 53 and 54 respectively directed through the second link first segment 50 permit positioning of the second pivot axle 29 to provide for a greater or reduced movement of the cross hair 45 upon vertical displacement of the cross hair actuator linkage 44.

Furthermore, the fastener 55 permits relative angulated adjustment of the first and second link segments 50 and 51 relative to one another to alter the spacing of axle 27 to the pivot axle 29. This adjustability permits the invention to be fully tuned and adjusted relative to a variety of bows.

As to the manner of usage and operation of tile instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery sighting apparatus arranged for securement to an archery bow, with the archery bow having a bow hand grip and a bow riser, and the apparatus mounted to the bow riser, with the apparatus comprising, a sight housing, the sight housing including a rear wall spaced from a front wall, and a first side wall spaced from a second side wall, the second side wall having a plurality of second side wall fasteners arranged for securement to the bow riser, and the sight housing having a longitudinally aligned cavity directed through the sight housing, and a trigger lever mounted pivotally below the sight housing, the sight housing including a first link, the first link having a first link first end and a first link second end, and the first link first end including a first link pivot axle, with the pivot axle orthogonally mounted to the sight housing rear wall, the first link including a slot, and an L-shaped second 1 ink, with the L-shaped second link positioned above the first link and the second L-shaped second link including a second link first end and a second link second end, with the second link first end having a second link first pivot axle pivotally mounting the first link to the second link with the slot, and the second link first pivot axle positioned between the first link first end and the first link second end, and a first link second pivot axle directed orthogonally through the second link and threadedly received through the housing rear wall to pivotally mount the second link relative to the rear wall, and a second link second end having a row of apertures between the second link second pivot axle and the second link second end, and an actuator rod, and the actuator rod including an actuator rod first end received through one of said apertures, and the actuator rod second end pivotally mounted to the trigger lever, and mirror means mounted within the sight housing for optical alignment of a target relative to an archery shooter, and the mirror means includes a first mirror plate, wherein the first mirror plate includes a first mirror plate reflective surface and a first mirror plate opaque surface, with the first mirror plate opaque surface in confronting relationship relative to the rear wall within the cavity, and the second pivot axle having an inner end, with the inner end arranged in abutment with the first mirror plate opaque surface, and the housing front wall including a front wall opening, and the front wall opening positioned in adjacency relative to the first mirror plate, and the first mirror plate inclined at a first acute included angle relative to the rear wall, and the first mirror plate having a first mirror plate pivot hinge mounted to the first mirror plate and to the rear wall within the cavity, with a spring to bias abutment of the first mirror plate to the second link's pivot axle inner end, and the mirror means further includes a second mirror plate mounted within the cavity below the first mirror plate, and the second mirror plate includes a second mirror plate reflective surface arranged in confronting relationship relative to the rear wall within the cavity, the front wall having a further front wall opening below the front wall opening in adjacency to the second mirror plate, the rear wall having a rear wall opening in alignment with the further front wall opening, with the rear wall opening providing a first line of sight through the further front wall opening, and a second line of sight directed through the rear wall opening reflected from the second mirror plate to the first mirror plate and through the front wall opening, with the second mirror plate defining a second acute included angle between the second mirror plate and the front wall within the cavity.

2. An apparatus as set forth in claim 1 including an actuator link having an actuator link cross hair directed from the actuator link across the further front wall opening and the second mirror plate, and an actuator link second end secured to the first link second end to effect displacement of the cross hair upon pivotment of the trigger lever.

3. An apparatus as set forth in claim 2 wherein the trigger lever includes a first leg orthogonally and intergrally mounted to a second leg, with the second leg having a second leg finger opening directed therethrough for manual grasping of the second leg, and a trigger lever pivot axle, with the trigger lever pivot axle directed orthogonally through the trigger lever at an intersection of the first leg to the second leg, and a mounted plate receiving the trigger lever pivot axle to pivotally mount the trigger lever relative to the mounting plate, with the mounting plate arranged for securement to the bow riser.

* * * * *